United States Patent [19]

Schaefer

[11] 4,415,954

[45] Nov. 15, 1983

[54] GRIP SHIELD

[75] Inventor: Roger W. Schaefer, San Luis Obispo, Calif.

[73] Assignee: Centurion Safety Products, Inc., San Luis Obispo, Calif.

[21] Appl. No.: 370,932

[22] Filed: Apr. 23, 1982

[51] Int. Cl.[3] ..... F21L 7/00

[52] U.S. Cl. ..... 362/202; 362/189; 362/253; 362/389; 362/457; 74/551.9

[58] Field of Search ..... 362/253, 189, 389, 202, 362/457; 74/551.9

[56] References Cited

U.S. PATENT DOCUMENTS 2,143,558 1/1939 Joers ..... 362/189
2,666,340 1/1954 Hunt ..... 74/551.9
3,606,326 9/1970 Sparks et al. ..... 74/551.9
3,614,100 10/1971 Spitz ..... 74/551.9

*Primary Examiner*—Stephen J. Lechert, Jr.
*Attorney, Agent, or Firm*—Daniel C. McKown

[57] ABSTRACT

A protective sleeve that can be slipped over the knurled barrel of a flashlight or similar article to protect surrounding objects from the abrasive action of the knurling is composed of a resilient slip-resistant vinyl. When applied over the barrel of the flashlight, the vinyl sleeve provides a non-abrasive but slip-resistant surface for gripping. The inside diameter of the sleeve is less than the outside diameter of the barrel of the flashlight, and a household detergent is used as a lubricant to facilitate slipping the sleeve onto the barrel of the flashlight.

3 Claims, 3 Drawing Figures

GRIP SHIELD

BACKGROUND OF THE INVENTION

1. Field of the Invention

The present invention is in the field of flashlights and specifically relates to a protective shield and grip-enhancing sleeve for use with such devices.

Contemporary flashlights of professional quality find wide use among persons working in law enforcement, fire and rescue, and sportsmen. FIG. 1 shows such a flashlight. Typically, the outer case 12 of the flashlight is metal or plastic and the flashlight includes an elongated barrel 14 which typically contains two to six energy cells of size C or size D. The barrel 14 normally includes a knurled section 16 which permits the user to maintain a secure grip on the flashlight, although some flashlights have little or no gripping surface.

It has been found that the knurled section 16 produces excessive wear on fabrics against which it rubs, for example the seats of cars and the clothing worn by the user. This problem cannot be solved merely by omitting the knurling from the barrel 14, because that would leave the barrel smooth so that it could slip or be pulled from the hands of the user too readily. The present invention is intended to solve this problem without requiring permanent modification of the flashlight.

2. Summary of the Invention

The present inventor recognized that the knurled section 16 of the barrel could be covered with a sleeve to protect the objects with which the barrel would normally come into contact from being scratched or abraded by the knurled section 16. Several difficulties became evident upon further investigation. For example, it is desirable that the sleeve to be applied over the barrel 14 should be resistant to slipping along the barrel. It is also desirable that any sleeve should present to the user an anti-slip surface to grip, offering superior gripping ability to that present prior to installation of the sleeve. Further, it is desirable that the sleeve not contain any longitudinal slits that would interfere with the action of the tensional forces that would be set up in a sleeve that is stretched diametrically to fit over the barrel.

In accordance with a preferred embodiment of the present invention, there is provided a sleeve of a slip-resistant material that can be forced over the end 18 of the flashlight when the flashlight barrel 14 has been lubricated.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

In accordance with a preferred embodiment of the present invention, there is provided a resilient sleeve 20 having a diameter, in its unstretched state, slightly smaller than the diameter of the barrel 14 of the flashlight. The sleeve 20 is composed of a slip-resistant resilient material, and in a preferred embodiment is composed of a soft vinyl.

It was by no means apparent to the present inventor how a slip-resistant sleeve having an unstretched diameter less than the diameter of the barrel 14 of the flashlight could be applied to the barrel. After much experimentation, the present inventor found that if the barrel 14 of the flashlight is coated with a liquid detergent solution of the type used for household dishwashing and laundry chores, the sleeve 20 could then be pushed onto the barrel over the end 18. In time, the applied detergent dries and thereafter serves as an adhesive to cause the sleeve 20 to stick to the barrel 14. The ability of the sleeve 20 to stick to the barrel 14 is further enhanced by the elastic restoring forces set up in the sleeve by virtue of its being stretched diametrically over the barrel. Also, the knurling on the knurled section 16 of the barrel further resists slipping of the sleeve 20 along the barrel.

Figure 1:
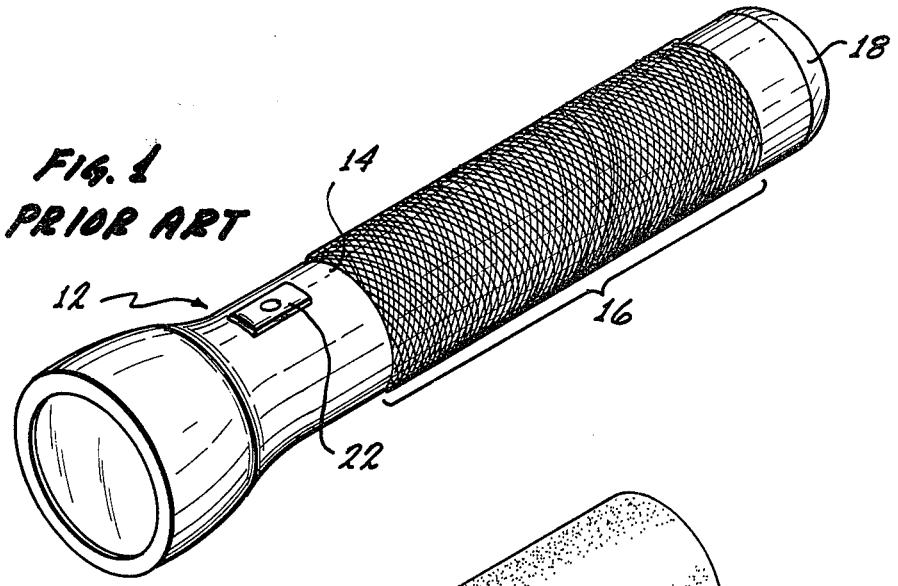
FIG. 1 PRIOR ART
FIG. 1 is a perspective view showing a flashlight of the type known in the prior art.
Figure 2:
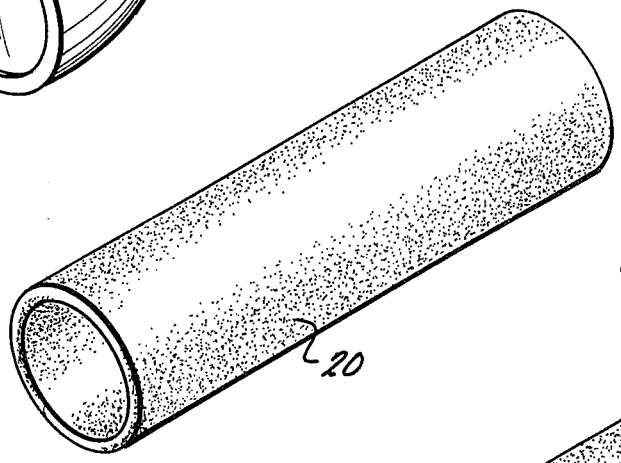
FIG. 2 is a perspective view of a grip shield sleeve of the type used in a preferred embodiment of the present invention; and, FIG. 3 is a perspective view showing the grip shield sleeve installed on the flashlight of FIG. 1.
Figure 3:
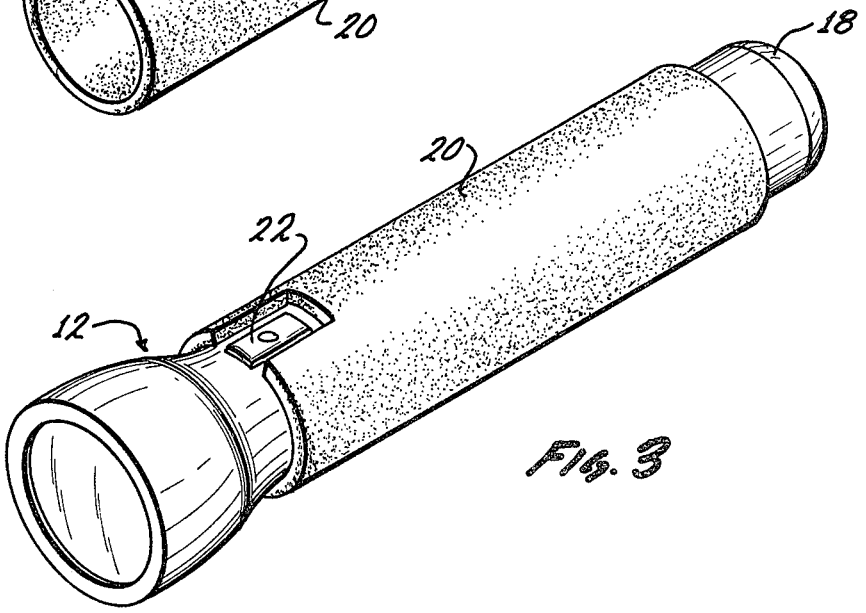

FIG. 3 shows the sleeve after it has been applied to the barrel of the flashlight. The sleeve 20 is normally supplied in a length adequate for even the longest professional flashlights. The purchaser of the sleeve then cuts it to an appropriate length and may also cut out a section to allow access to the switch. Alternatively, the sleeves may be supplied pre-cut to various lengths suitable for flashlights of different lengths.

Thus, there has been described a resilient slip-resistant sleeve that can be slipped over the barrel of a flashlight to provide a slip-resistant grip while at the same time protecting objects from the sharp knurling normally present on the barrel of the flashlight. When the sleeve is in place, the grip provided to the user has a larger diameter than the diameter of the barrel of the flashlight, and this is beneficial when the user holds the flashlight between his arm and his body to free both of his hands for other activities.

There has also been described a method for slipping a tight-fitting slip-resistant sleeve over a knurled barrel by first lubricating the barrel with a household detergent.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A flashlight having an improved hand grip, comprising:

a barrel portion of the flashlight having an elongated cylindrical shape;

a sleeve of a resilient non-abrasive slip-resistant material, having an inside diameter in its relaxed state less than the outside diameter of said barrel portion, said sleeve extending over the surface of said barrel portion and squeezing said barrel by virtue of said sleeve being stretched from its relaxed state to fit over said barrel portion, said sleeve being open at both of its ends so as not to enclose either end of the flashlight; and, a coating of dried lubricant between said sleeve and said barrel portion bonding said sleeve to said barrel portion so that said sleeve can not be non-destructively removed from said barrel portion.

2. The article of claim 1 wherein said sleeve is composed of soft vinyl.

3. The flashlight of claim 1 wherein said coating of a lubricant consists of a household detergent.

* * * * *